US009677841B2

(12) United States Patent
Hughes et al.

(10) Patent No.: US 9,677,841 B2
(45) Date of Patent: Jun. 13, 2017

(54) CABLE ATTACHMENT FITTING FOR A BOW

(71) Applicant: Bear Archery, Inc., Evansville, IN (US)

(72) Inventors: Andrew Hughes, Evansville, IN (US); Josh Sidebottom, Spencerport, NY (US); Casey Tenbarge, Evansville, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 15/278,182

(22) Filed: Sep. 28, 2016

(65) Prior Publication Data

US 2017/0097206 A1 Apr. 6, 2017

Related U.S. Application Data

(60) Provisional application No. 62/236,261, filed on Oct. 2, 2015.

(51) Int. Cl.
*F41B 5/10* (2006.01)
*F41B 5/14* (2006.01)
*F41B 5/12* (2006.01)

(52) U.S. Cl.
CPC ..... *F41B 5/1403* (2013.01); *F41B 5/10* (2013.01); *F41B 5/105* (2013.01); *F41B 5/123* (2013.01)

(58) Field of Classification Search
CPC ..... F41B 5/10; F41B 5/123
See application file for complete search history.

(56) References Cited

U.S. PATENT DOCUMENTS

| | | | | |
|---|---|---|---|---|
| 3,108,583 | A | 10/1963 | Andis | |
| 4,169,456 | A | 10/1979 | Van House | |
| 4,178,904 | A | 12/1979 | Meininger | |
| 4,440,142 | A | 4/1984 | Simonds | |
| 4,546,754 | A * | 10/1985 | Smith | F41B 5/10 124/25.6 |
| 4,733,648 | A | 3/1988 | Martin | |
| 4,766,874 | A | 8/1988 | Nishioka | |
| 4,781,167 | A | 11/1988 | Martin | |
| 4,879,987 | A | 11/1989 | Nishioka | |
| 4,909,231 | A | 3/1990 | Larson | |
| 4,926,833 | A | 5/1990 | Darlington | |
| 5,381,777 | A | 1/1995 | Mitchell et al. | |
| 5,630,405 | A | 5/1997 | Nizov | |
| 5,697,355 | A * | 12/1997 | Schaffer | F41B 5/105 124/25.6 |
| 5,809,984 | A * | 9/1998 | Johnson | F41B 5/105 124/25.6 |
| 7,328,693 | B2 | 2/2008 | Kempf | |
| 7,363,921 | B2 | 4/2008 | Kempf | |
| 7,836,871 | B2 | 11/2010 | Kempf | |
| 7,938,108 | B2 | 5/2011 | Popov et al. | |
| 8,020,544 | B2 | 9/2011 | McPherson et al. | |
| 8,056,548 | B1 | 11/2011 | Larson | |
| 8,069,847 | B2 | 12/2011 | Blosser | |

(Continued)

*Primary Examiner* — John Ricci
(74) *Attorney, Agent, or Firm* — Woodard, Emhardt, Moriarty, McNett & Henry, LLP; Charles Meyer

(57) ABSTRACT

Certain embodiments of the present disclosure describe a fitting for attaching a cable to a bow. The cable attachment fitting attaches near a cam to provide an offset between the cam of the bow and a cable attached at the cable attachment fitting.

20 Claims, 5 Drawing Sheets

(56) References Cited

U.S. PATENT DOCUMENTS

| | | | | |
|---|---|---|---|---|
| 8,371,283 | B2 | 2/2013 | Grace et al. | |
| 8,408,193 | B2 * | 4/2013 | McPherson | F41B 5/105 124/25.6 |
| 8,656,900 | B1 | 2/2014 | Kronengold et al. | |
| 8,794,225 | B2 * | 8/2014 | Bednar | F41B 5/105 124/25 |
| 8,919,332 | B2 | 12/2014 | Trpkovski | |
| 8,991,376 | B2 | 3/2015 | McPherson | |
| 9,303,945 | B1 | 4/2016 | Hughes et al. | |
| 2006/0011190 | A1 * | 1/2006 | Andrews | F41B 5/105 124/89 |
| 2010/0269808 | A1 | 10/2010 | Evans | |
| 2015/0226511 | A1 | 8/2015 | Chang | |
| 2016/0377369 | A1 * | 12/2016 | Bednar | F41B 5/105 124/25 |

* cited by examiner

CABLE ATTACHMENT FITTING FOR A BOW

The present application claims the benefit of provisional application Ser. No. 62/236,261 filed on Oct. 2, 2015, which is incorporated herein by reference.

FIELD OF THE INVENTION

Aspects of the present invention deal with archery bows, and in particular deal with fittings that may be used with a cable arrangement on a bow.

BACKGROUND OF THE INVENTION

Compound bows are archery bows that use a system of cables and cams to bend the limbs of the bow to generate potential energy that is transferred to an arrow or bolt. In addition to a bowstring, many compound bows include a system of power cables that extend between the cams and act to pull the limbs together as the cams are rotated. Aspects of the present disclosure address a different type of attachment method for the power cables.

SUMMARY

In certain embodiments, a fitting is illustrated which can be used with a cable arrangement on a compound type of bow such as a crossbow or a vertical compound bow. The cable attachment fitting may include an inner arm and an outer arm. The inner arm is offset from the outer arm, forming a limb opening. The outer arm may include a cable anchor and a cable guide. A guide surface may extend from the cable anchor.

The cable arrangement may include cables with yokes that allow the cable to be mounted to a cam axle on both sides of a cam. A cable attachment fitting may be attached to the cam axle on each side of the cam to receive an end of the yoke. Each of the cable attachment fittings has a height and/or radial length that offsets [the cable]??? from the cam.

In some embodiments, the cable angles from the joint of the yoke toward a cable fitting, where the cable passes through a cable passage. The cable then runs along a guide surface and is secured to an anchor. In some embodiments, the cable is substantially parallel to the cam as it travels along the guide surface. The height offset due to the height of the cable attachment fitting and the radial offset due to the length of the guide surface help provide clearance between the cable and the radius of the cam during rotation of the cam and bending of the limbs.

Additional objects and advantages of the described embodiments are apparent from the discussions and drawings herein.

DESCRIPTION OF PREFERRED EMBODIMENTS

Figure 1:
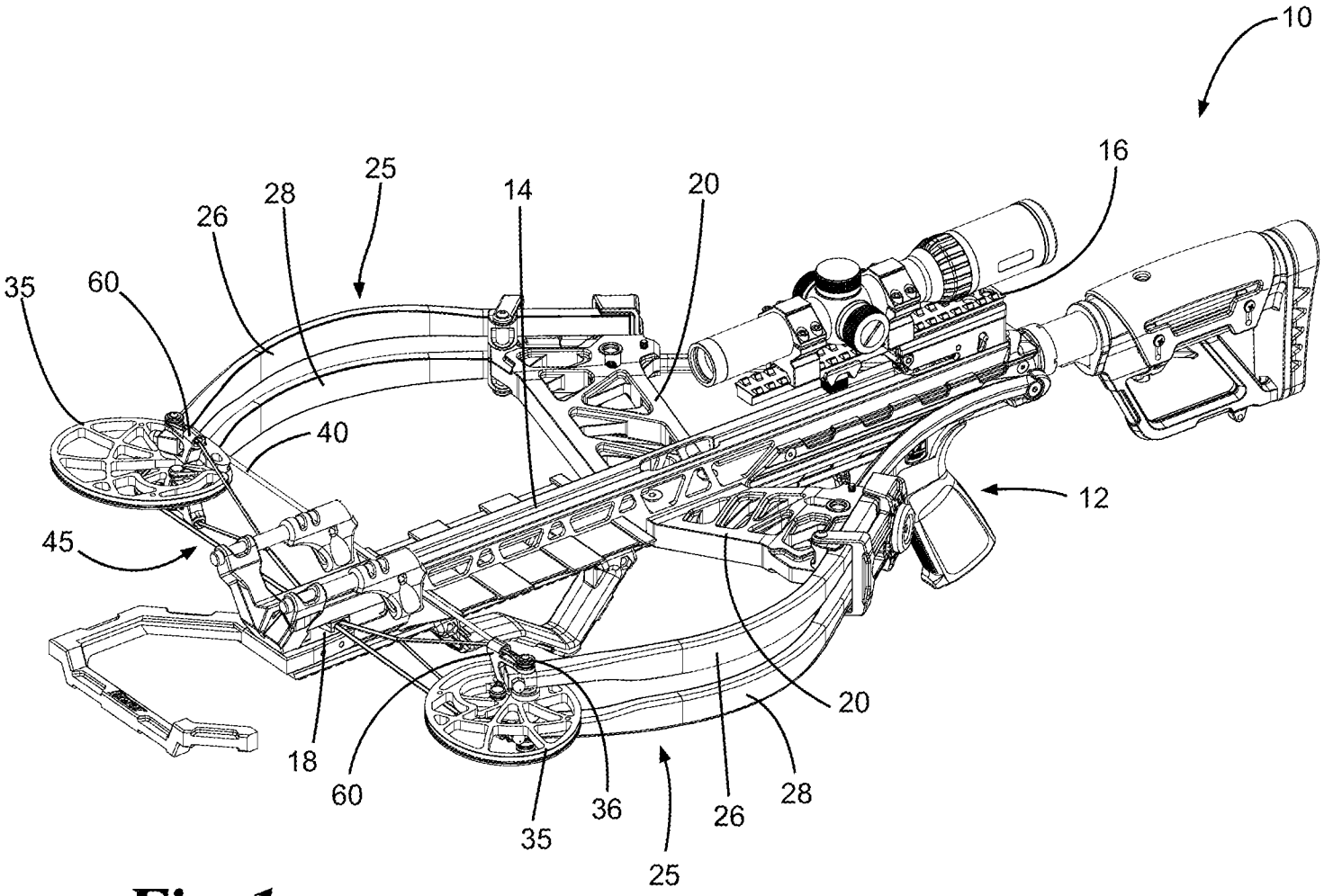
FIG. 1 is a perspective view of an embodiment of a crossbow.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Compound archery bows use a system of cables and rotatable pulleys or cams to bend the limbs of the bow and produce potential energy that is transferred to a fired arrow or bolt as kinetic energy. A let-off feature of the compound bow reduces the draw-force required to draw the bowstring as the bowstring progresses to being fully drawn. Cables extend between the cams and act to pull the limbs of the bow together as the cams are rotated when the bowstring is drawn. Both vertical bows, which typically have vertically oriented limbs, or crossbows, which typically have horizontally oriented limbs, may be compound archery bows and include a system of cables and pulleys.

Figure 6:
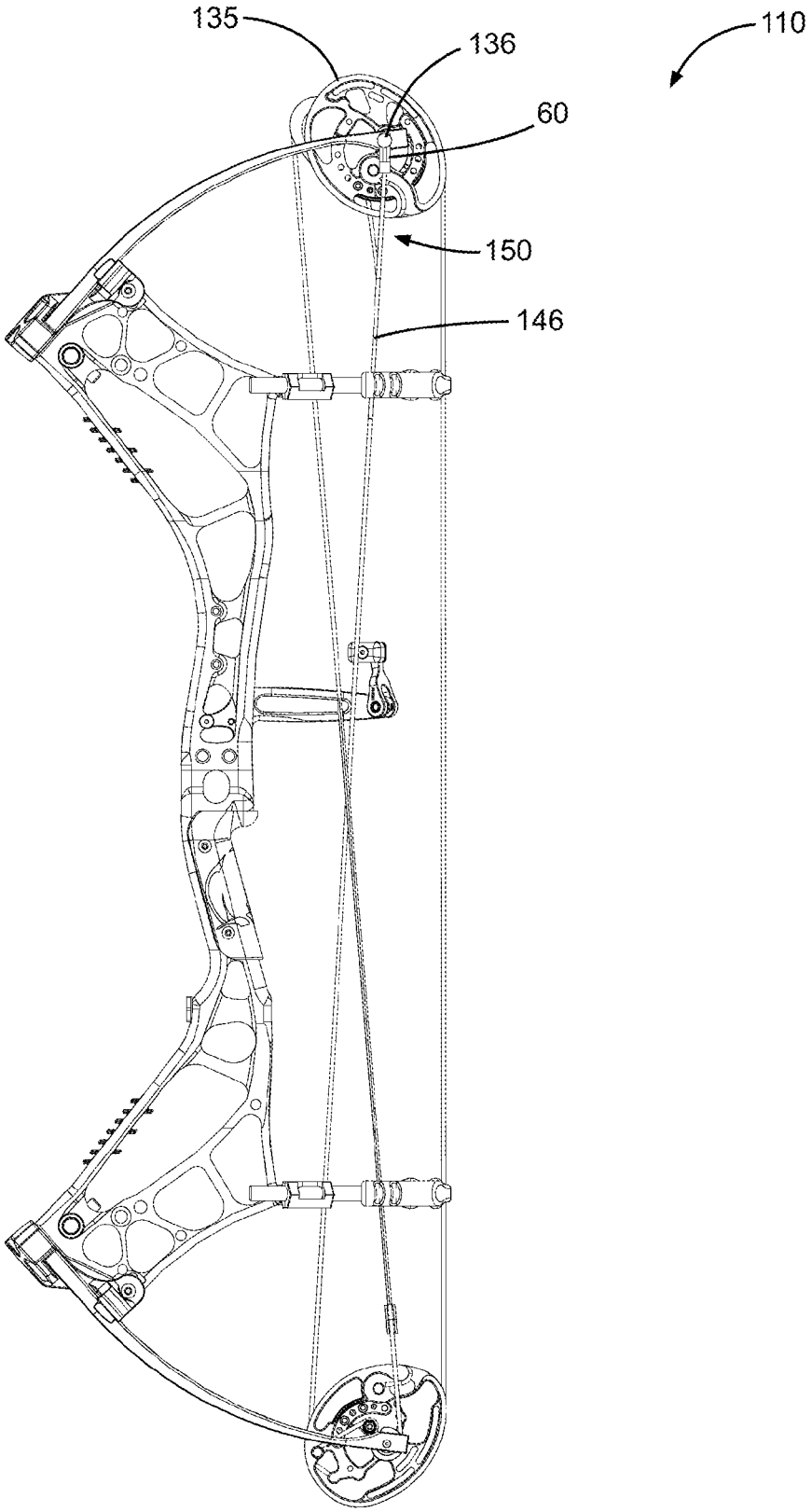
FIG. 6 is a side view of a vertical compound bow with a pair of cable attachment fittings of FIG. 3 attached.

Although a crossbow is shown as a representative example in FIG. 1, the use of a cable attachment fitting is not restricted to use on crossbows. The cable attachment fitting may be used on a variety of different kinds of compound type archery bows. For example, the cable attachment fitting may be used on a compound vertical bow (FIG. 6). Directional terms within this description are used for ease of reference and should not be considered limiting. For example, the terms upper and lower may be used to describe features of a drawing depicting a crossbow, but it should be recognized that these features may also be used on a vertical bow with a similar structure but in a different directional orientation or position.

In compound bow arrangements, cross-cables or power cables sometimes have one end mounted to a cam axle. Often, a cable transitions to a y-shaped yoke at a cable joint so that the cable is anchored to the axle on both sides of the cam, balancing the cable to minimize torque loads on the cam. Certain embodiments shown in FIGS. 1-6 include a cable attachment fitting which can be used with a cable arrangement on a bow. Often this cable arrangement includes a y-shaped yoke. More specifically, the fitting is used as a spacer, to help prevent a cable from touching a cam. In typical embodiments, the fitting(s) may be used with cam and cable arrangements, and more specifically when a cable is mounted to or adjacent an axle of a cam.

In configuring a crossbow, the power cable arrangement needs to maintain sufficient clearance from the cams during the entire draw and release cycle. Simultaneously, as the bow is drawn and the limbs are bent, the power cable joints are each drawn toward the rail and stock, and particularly toward the slot or cable guide opening. Preferably, the power cable lengths including the spacing between the opening and the joints are configured so that the joints do not intersect or enter the opening, even at full draw. In an arrangement without cable fittings, to provide sufficient cam clearance, the yoke would form a narrower/deeper "V" profile between the opposing axle ends and the joint. In contrast, when cable fittings are used, the wider divergence angle forms a wider/shallower "V" profile. This enables the joints to be spaced closer to the cam and further from the stock opening than would be achievable without the fittings.

In certain alternate embodiments the clearance provided by the fittings allows a larger radius cam to be used while maintaining the joint in approximately the same place. A larger cam radius allows more cable track length for the bowstring and/or the power cable arrangement, which can be useful in providing a mechanical advantage.

Each fitting has a height or width which offsets the cable connection along the axle away from the cam along the axis of the axle. Correspondingly, an axle length may need to be used which extends a sufficient height or width beyond the limbs. The end of the cable is anchored to the fitting at the offset height. The fittings then each have a lateral or radial length, generally parallel to the plane of the cam, with a guide surface which supports an end length of the cable for a short distance. The guide surface holds that end length away from the cam, for example in a parallel spacing. The cable then angles toward the joint of the y-yoke from a divergence point at the distal end of the fitting, spaced from the axle by the lateral or radial length. The fitting may include a guide mounting, such as a passage, groove, or opening, to prevent the cable from falling off of the guide surface. The length of the guide surface is calculated to ensure sufficient clearance between the cable and the cam radius during use of the bow, including during rotation of the cam and bending of the limbs.

A side of the fitting proximal the axle may define an opening in a fork arrangement, for example between a pair of arms. The arms are pivotally mounted to the axle. A limb tip may be arranged on the axle within the opening, allowing the fitting to straddle that portion of the limb tip. The inner arm, closer to the cam, may extend laterally inward to clear the limb tip, and then toward the outer arm, forming a support portion which assists in bracing the outer arm against inward tension applied by the cable. The support portion may be slanted at an angle approaching perpendicular to the diverging cable portion of the yoke as it approaches the fitting.

Figure 2:
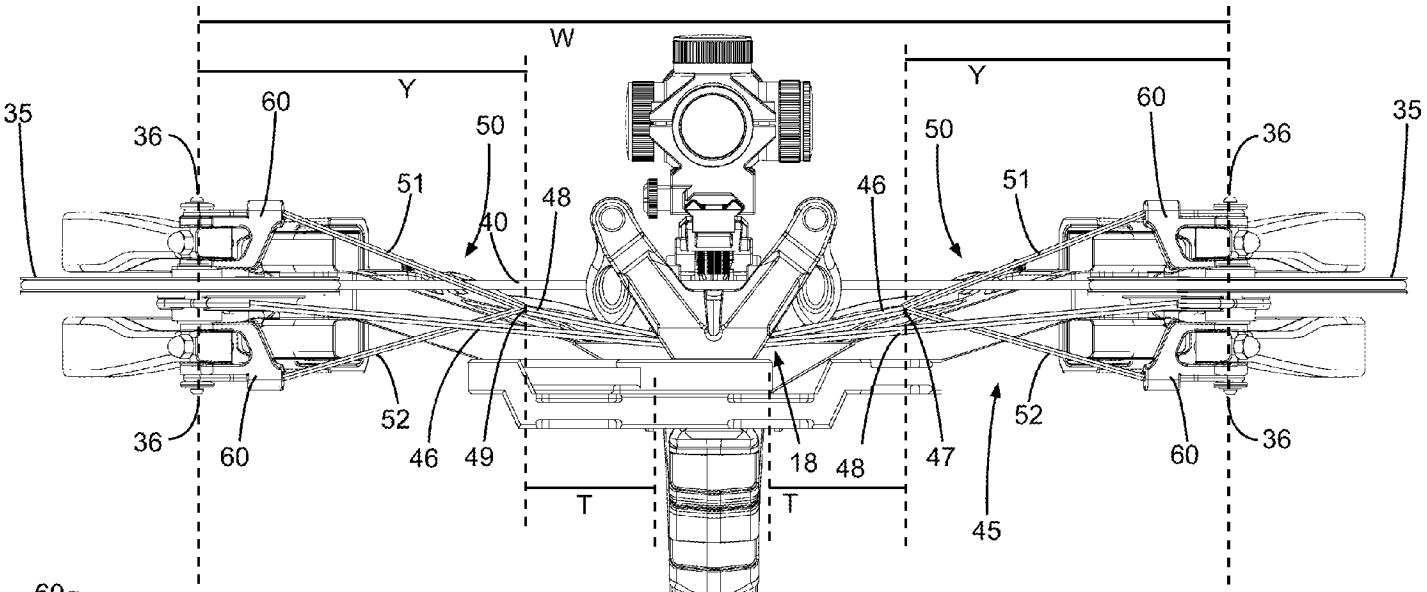
FIG. 2 is a front view of the crossbow of FIG. 1.

FIGS. 1 and 2 illustrate a representative example of an archery bow assembly such as crossbow 10. Crossbow 10 generally includes a stock 12 and a rail 14 sits on top of stock 12. Stock 12 may include a trigger mechanism. An accessory rail 16 may be included on top of the trigger mechanism to be used as a mounting point for accessories such as a scope or a light.

A riser assembly 20 may extend from stock 12. A pair of archery bow limbs 25 is mounted to extend from opposing ends of the riser assembly. A rotatable element such as a cam 35 is positioned at the end or limb tip of each limb 25 and pivotally secured to a respective limb 25 by a cam axle 36 defining a pivot axis. In some embodiments, the rotatable element may be an eccentric cam, in which the center of rotation of cam 35 is different from the geometric center of cam 35. In alternate embodiments the rotatable element may be a pulley, wheel or cam with a central axle axis. In some embodiments, limbs 25 are made as split or "quad" limbs formed by two pairs of limb portions, namely limb portion 26 and a limb portion 28, one pair extending from each opposing end of the riser assembly. Alternately, each limb may be one piece with a slot defined at the limb tip to receive a rotatable element. A bowstring cable 40 extends from each rotatable element, for example it can be partially wrapped around each of the cams 35 and extends between limbs 25. The bowstring cable can be directly anchored to the cams and/or extends into a bowstring track on one or both cams. A power cable arrangement 45 also extends between limbs 25.

As shown in FIG. 2, the cam axles 36 are separated by axle-to-axle width W. A power cable arrangement 45 includes two cables 46, 48 with each having one end attached to a cam 35, typically received in a power cable track. Cables 46, 48 each then extend across the bow, for example, through a slot or opening 18 under rail 14 or a similar cable guide toward the opposite cam 35. Cables 46, 48 each extend to a cable joint 47, 49, respectively, where cables 46, 48 each transition to a y-yoke 50 at cable joints 47, 49, respectively. Each yoke defines a distance Y from the cam axle axis to the yoke joint 47 or 49. Yoke 50 includes a first cable and a second cable, such as upper cable 51 and lower cable 52 (see FIG. 4), that diverge to opposite sides of cam 35. The first and second cables may be portions of one cable which passes through a joint, for example with bundles of separated cable strands so the cable branches at the joint and then continues. Alternately, the first and second cables may be separate cables which are attached or anchored to a cable 46, 48 at a joint, either directly or via an anchor piece. When the bow is drawn, cables 46, 48 are drawn into tracks on the cam opposite to their respective yokes. This draws the limbs inward, and joints 47, 49 translate toward opening 18 within range T. Joints 47, 49 typically do not enter opening 18. The joints return to their initial positions when the bow is released propelling an arrow.

Upper cable 51 and lower cable 52 each attach to a respective axle end via a respective cable attachment fitting 60. Upper cable 51 and lower cable 52 are non-linear as they extend from the joint to the axle. Upper cable 51 attaches to a cable attachment fitting 60 that is attached to cam axle 36 and located on one side of cam 35, and lower cable 52 attaches to a cable attachment fitting 60 that is attached to cam axle 36 on the opposite side of cam 35.

Figure 4:
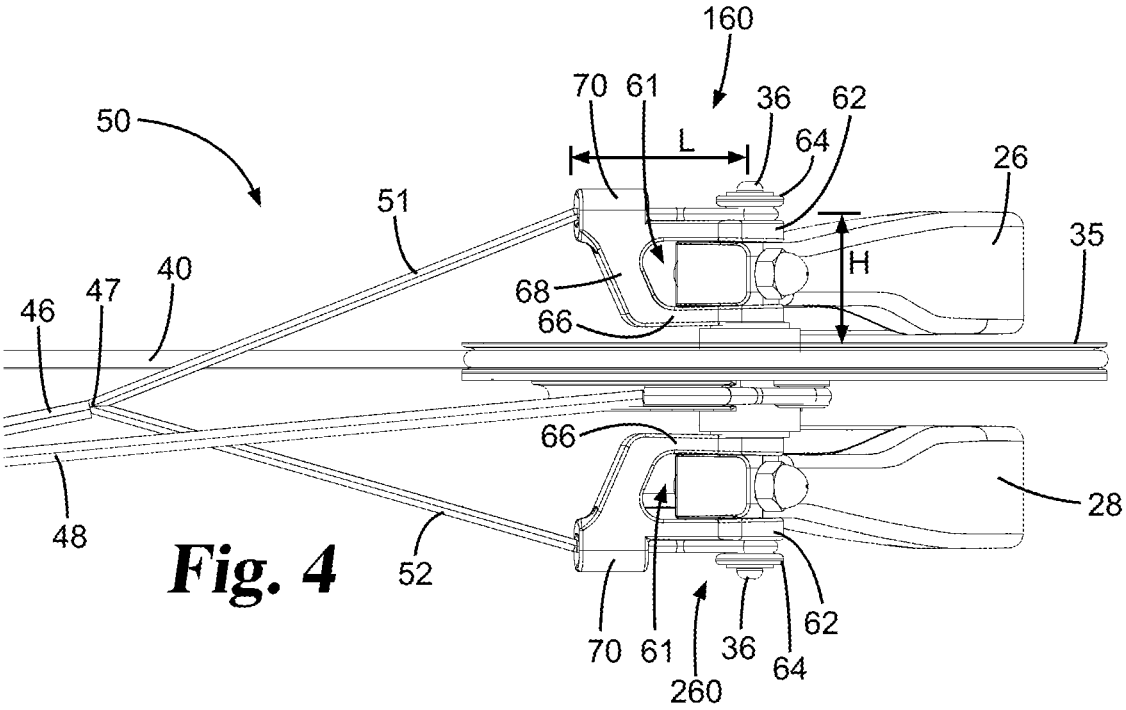
FIG. 4 is a front view of a pair of cable attachment fittings of FIG. 3 attached to the crossbow of FIG. 1.

Upper cable 51 and lower cable 52 may be of equal length between a cable joint 47, 49 and opposing ends of axle 36. Alternately, upper cable 51 and lower cable 52 may be of different real or effective lengths, which can be configured to balance their respective applied loads on cam axle 36 to minimize the introduction of any cant or lean to the cam. For example as illustrated in FIGS. 2 and 4, cable 46 is slightly upwardly angled as it approaches cam 35 from the opening or cable guide 18 where the cable passes through stock 12 under rail 14. If upper cable 51 and lower cable 52 are of equal length, their equal force applied to axle 36 would urge axle 36 to be perpendicular to the axis of cable 46. This would tend to urge cam 35 to lean out of alignment with bowstring cable 40. To avoid and/or minimize the introduction of any cant or leaning force, upper cable 51 may be slightly longer than lower cable 52 to unequally allocate the force applied by cable 46. Lower cable 52 can be made shorter by being made in an actual length shorter than upper cable 51 or alternately, for example, by twisting lower cable 52 to make it effectively shorter.

Figure 3:
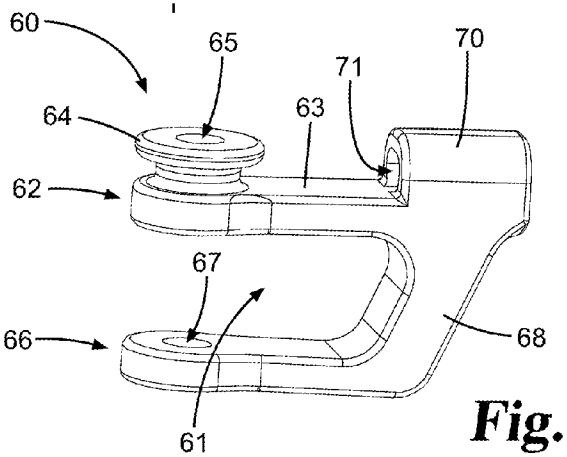
FIG. 3 is a perspective view of a cable attachment fitting from the crossbow of FIG. 1.

Cable attachment fitting 60, shown in more detail in FIG. 3, includes an outer arm 62 and an inner arm 66 as part of a fork arrangement to be arranged on opposing sides of the limb tip. A support portion 68 connects outer arm 62 to inner arm 66 and allows outer arm 62 to be vertically offset from inner arm 66. The fork forms a limb opening 61. Support portion 68 may be slanted at an angle approaching perpendicular to a cable 51 or 52 of yoke 50 as cable 51 or 52 approaches cable attachment fitting 60 (see axes A and B in FIGS. 5A and 5B).

One end of outer arm 62 may include a cable anchor 64. The other end of outer arm 62 may include a cable guide 70, for example that defines a cable passage 71. A guide surface 63 may extend between cable anchor 64 and cable passage 71. As illustrated, the guide surface 63 is parallel to and spaced on an opposite side of the limb tip from cam 35. In some embodiments, guide surface 63 may include guide features for preventing a cable from falling off guide surface 63. For example, guide surface 63 may be textured to increase friction between a cable and guide surface 63, or guide surface 63 may include a track, groove or passage.

Outer arm 62 defines an outer axle opening 65. In some embodiments, outer axle opening 65 may extend through cable anchor 64. Inner arm 66 defines an inner axle opening 67 that is aligned with outer axle opening 65 to allow a cam axle 36 to pass through fitting 60.

In use on a crossbow, as shown in FIG. 4, a first cable attachment fitting, such as upper cable attachment fitting 160 may be arranged on one side of cam 35 and a second cable attachment fitting, such as lower cable attachment fitting 260 may be arranged on the opposite side of cam 35. The inner arms 66 of upper fitting 160 and lower fitting 260 are each positioned closer to the cam 35 than outer arms 62. Outer arm 62 of upper fitting 160 and outer arm 62 of lower fitting 260 may be positioned so that each of the outer arms 62 and their respective guide surfaces are substantially parallel to yet spaced in height apart from the plane of cam 35.

The limb tip of limb portion 26 is positioned in limb opening 61 of upper fitting 160. Correspondingly, the limb tip of limb portion 28 is positioned in limb opening 61 of lower fitting 260. Cam axle 36 extends through the outer axle opening 65 of upper fitting 160, limb portion 26, and the inner axle opening 67 of upper fitting 160. Cam axle 36 then extends through an axle opening defined by cam 35, and into inner axle opening 67 of lower fitting 260, limb portion 28, and outer axle opening 65 of lower fitting 260. Axle clips, washers, bearings, and/or spacers may be placed along the axle as desired.

Yoke 50 includes where cable 46 transitions at cable joint 47 to upper cable 51 and lower cable 52. Upper cable 51 follows a non-linear path. An initial portion of upper cable 51 is angled upward from joint 47 toward upper fitting 160 and may engage cable guide 70. Upper cable 51 bends when it contacts the cable guide and continues with a horizontal portion that extends along outer arm 62 across guide surface 63 to cable anchor 64 where upper cable 51 is secured to upper fitting 160. For example, cable 51 may terminate in a loop which encircles cable anchor 64. In some embodiments, as the upper cable 51 extends along outer arm 62, the horizontal portion of upper cable 51 is substantially parallel to cam 35. In certain alternate embodiments, upper cable 51 and lower cable 52 can terminate adjacent the distal end of guide surface 63, for example being anchored to cable guide 70. Force applied to cable guide 70 is then carried through the cable guide structure to the axle.

Lower cable 52 extends downward toward lower fitting 260 and may engage cable guide 70. Similarly, lower cable 52 follows a non-linear path. An initial portion of lower cable 52 is angled downward from joint 47 toward lower fitting 260 and may engage cable guide 70. Lower cable 52 bends when it contacts the cable guide and continues in a horizontal portion that extends along outer arm 62 across guide surface 63 to cable anchor 64 where lower cable 52 is secured to lower fitting 260. For example, cable 52 may terminate in a loop which encircles cable anchor 64. In some embodiments, as lower cable 52 extends along outer arm 62, the horizontal portion of lower cable 52 is substantially parallel to cam 35. A symmetric setup to what is shown in FIG. 4 may be used on the other cam 35 to attach cable 48.

In certain alternate embodiments, upper cable 51 and lower cable 52 can terminate adjacent the distal end of guide surface 63, for example being anchored to cable guide 70. Force applied to cable guide 70 is then carried through the fitting to the axle.

As shown in FIG. 4, attaching upper cable 51 to upper fitting 160 provides a height offset H that is determined by the distance from cam 35 to cable anchor 64. A radial offset length L measured from axle 36 is also created due to the radial length of upper fitting 160. The radial offset length extends beyond the thickness of the limb tip. The radial offset length may be longer or shorter as desired. In a representative embodiment, the radial offset length may be approximately 1.4 inches from the axle axis in proportion to an eccentric cam which varies in radius from approximately one to three inches. In some embodiments, a cam with a fixed radius may be used. In an eccentric cam configuration, the radial offset length can be determined while considering the longest and the shortest cam radius. A similar height and radial offset is created by lower fitting 260. These height and radial offsets create space between cables 51 and 52 and cam 35 as cables 51, 52 extend toward cable joint 47.

Figure 5A:
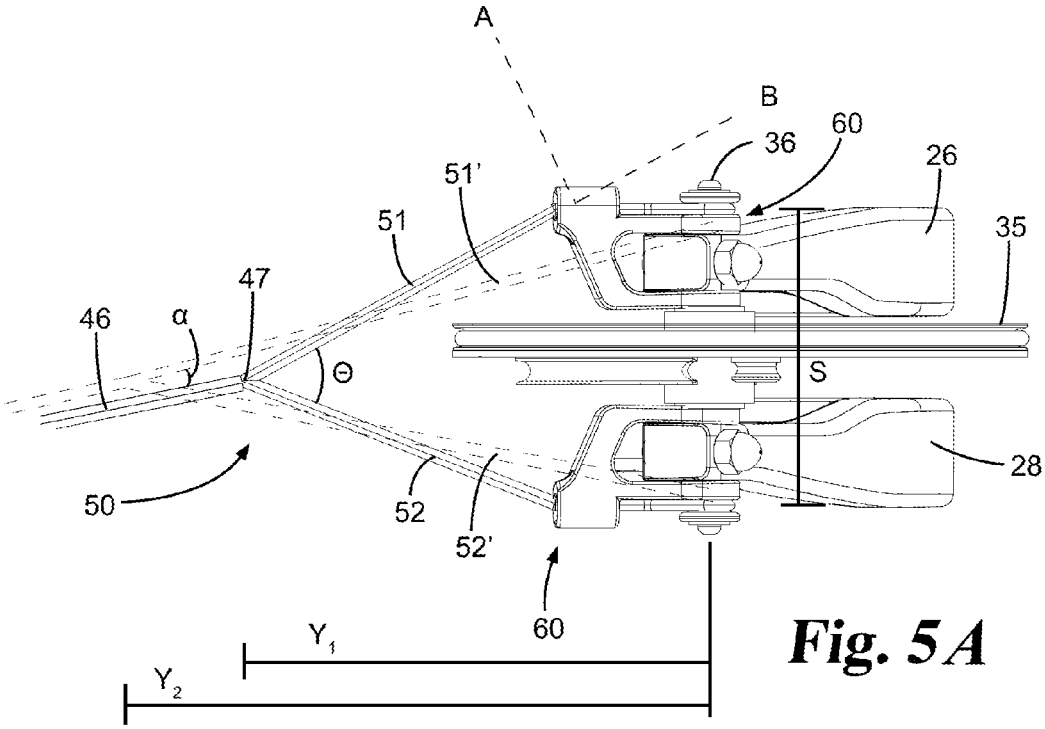
FIG. 5A is a front view of a cable and yoke attached to the crossbow of FIG. 1 approaching a cam using a pair of cable attachment fittings of FIG. 3 compared to a power cable attached without cable attachment fittings.

FIG. 5A illustrates yoke 50 approaching cam 35 using a pair of cable attachment fittings 60 with non-linear yoke cables compared to a yoke with linear cables directly attached to axle ends at the tips of limb portion 26 and limb portion 28. Upper cable 51' and lower cable 52' shown in dotted lines represent the position of a yoke if cable attachment fittings 60 were not included on crossbow 10 and upper cable 51' and lower cable 52' were instead secured to crossbow 10 at a location just above limb portion 26 and below limb portion 28 respectively.

When the fittings are not used, to maintain sufficient clearance between the yoke and the cam, upper cable 51' and lower cable 52' must be arranged with longer lengths that diverge/converge at a relatively narrow joint angle $\alpha$, forming a narrow "V" profile in the yoke. In comparison, when cable attachment fittings 60 are used, upper cable 51 and lower cable 52 can have lengths which diverge/converge at a wider joint angle $\theta$, forming a wider "V" profile. In certain embodiments, with the wider angle arrangement the axes of cables 51 and 52 do not intersect the pivot axis of axle 36 within the length of axle 36. The extra clearance provided by fittings 60 allows joint 47 to be placed closer to cam 35 while maintaining sufficient cam clearance. In turn, cable 46 can have a longer length extending between opening 18 and joint 47. This enables a longer distance where cable 46 can translate during the draw and release cycle without joint 47 entering opening 18.

As representative embodiments for purposes of illustration, the height separation S of the axle ends and respective guide surfaces 63 can be approximately 2.4 inches. In the arrangement of FIG. 5A, wider angle $\theta$ when using a pair of cable fittings 60 on a bow with an axle-to-axle width W of 17 or 18 inches, bow can be approximately 30 degrees or greater and joint 47 can be arranged at distance $Y_1$ approximately 5.8 inches from the axle axis. In comparison, to achieve the same clearance from the cam, a yoke without the fittings would have a narrower angle $\alpha$ of approximately 21 degrees and would extend to distance $Y_2$ approximately 6.4 inches from the axle axis. In an alternate representative embodiment on a bow with an axle-to-axle width W of 15 inches, wider angle θ when using a pair of cable fittings 60 can be approximately 35 degrees or greater and joint 47 can be arranged at distance $Y_1$ approximately 5.2 inches from the axle axis. In comparison, to achieve the same clearance, a yoke without the fittings would have a narrower angle α of approximately 23 degrees and would be offset approximately at distance $Y_2$ of 5.8 inches from the axle axis.

Figure 5B:
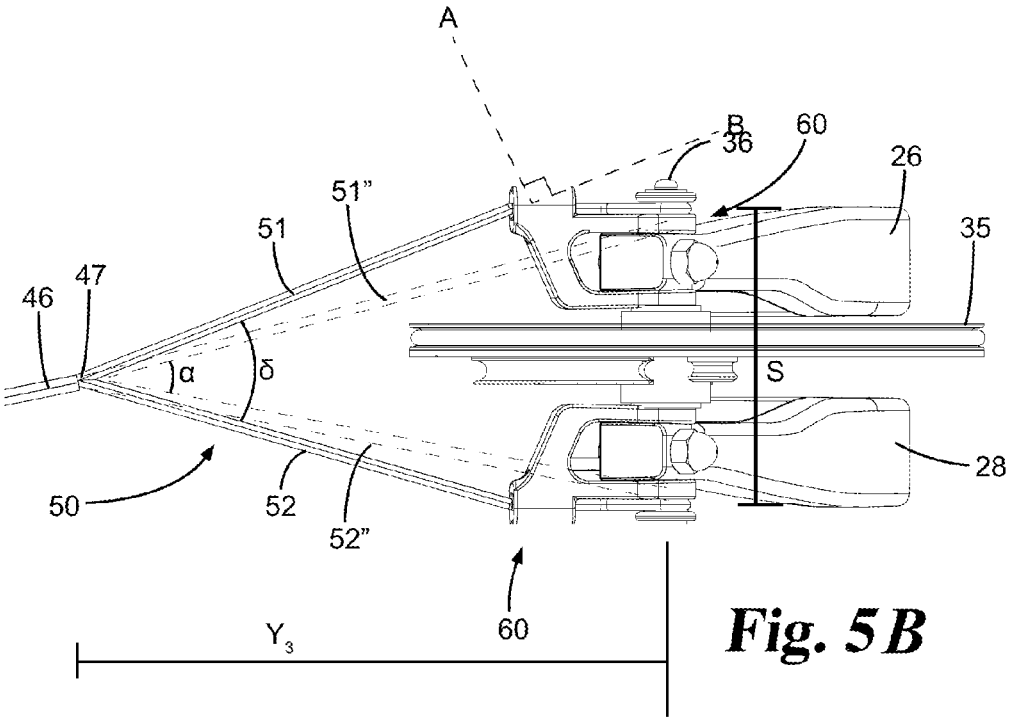
FIG. 5B is a front view of an alternate cable and yoke attached to the crossbow of FIG. 1 approaching a cam using a pair of cable attachment fittings of FIG. 3 compared to a power cable attached without cable attachment fittings.

FIG. 5B illustrates yoke 50 approaching cam 35 using a pair of cable attachment fittings 60 and non-linear yoke cables compared to a yoke extending from approximately the same joint location yet with linear yoke cables directly attached to axle ends at the tips of limb portion 26 and limb portion 28. Upper cable 51" and lower cable 52" shown in dotted lines represent the position of a yoke if upper cable 51" and lower cable 52" were directly secured to crossbow 10 at a location just above limb portion 26 and below limb portion 28 respectively. Upper cable 51" and lower cable 52" are much closer to cam 35 than upper cable 51 and lower cable 52. Using the cable attachment fittings causes yoke 50 to diverge at a wider joint angle, providing additional clearance of the power cable 46 and yoke 50 from cam 35. The extra clearance provided by fittings 60 reduces the likelihood of a misfire or causing damage to cam 35 or power cables 46, 48 due to cam 35 potentially contacting the yoke or cables when crossbow 10 is fired. In some embodiments, the larger clearance allows a larger diameter cam to be used, potentially with correspondingly longer cable tracks, while maintaining the yoke joint in approximately the same location.

When the fittings are not used, to maintain sufficient clearance between the yoke and the cam, upper cable 51" and lower cable 52" diverge/converge at a relatively narrow joint angle α, forming a narrower "V" profile in the yoke. In comparison, when cable attachment fittings 60 are used, upper cable 51 and lower cable 52 extending from the same joint position diverge/converge at a wider joint angle δ, forming a wider "V" profile. As illustrative embodiments, in certain embodiments the height separation S of the axle ends and respective guide surfaces 63 can be approximately 2.4 inches, and joint 47 can be located at distance $Y_3$ approximately 5.9 inches inward horizontally from the axle in a crossbow with an axle-to-axle width W of 17 or 18 inches. In the arrangement of FIG. 5B, wider angle δ when using a pair of cable fittings 60 can be approximately 30 degrees or greater. In comparison, a narrower angle α without the fittings would be approximately 23 degrees. In an alternate representative embodiment the height separation S of the axle ends and respective guide surfaces 63 can be approximately 2.4 inches, and joint 47 can be located at distance $Y_3$ approximately 5.25 inches inward horizontally from the axle axis in a crossbow with an axles-to-axle width W of 15 inches. In this example, wider angle δ when using a pair of cable fittings 60 can be approximately 35 degrees or greater. In comparison, narrower angle α without the fittings would be less than 26 degrees.

In certain embodiments, the joint angle of the "V" profile when a pair of cable fittings are used is approximately equal to or greater than 30 degrees. In further embodiments the joint angle is approximately equal to or greater than 35 degrees.

As shown in FIG. 6, cable attachment fittings 60 may also be used on a vertical bow 110. Similar to use with a crossbow, a cable attachment fitting 60 is attached to each side of a cam 135 at a cam axle 136. Vertical bow 110 has at least a pair of limbs extending from opposing ends of the riser. Alternately, a "quad" limb arrangement can be used including two pairs of limbs, with one pair of limbs extending from each opposing end of the riser. Cams 135 are mounted at the respective limb tips on respective axles. The cams may be symmetric or asymmetric. A pair of cable attachment fittings may be used with one or both cams, for example in configurations where a cable extends toward and is anchored to a cam axle. For example as illustrated in FIG. 6, a cable 146 extends from the lower cam toward the upper cam 135 and transitions to a yoke 150. The diverging cables of yoke 150 extend to both sides of cam 135 and are secured to a pair of symmetrically arranged cable attachment fittings 60. The diverging first and second or left and right cables of the yoke extend along respective outer arms across respective guide surfaces to cable anchors.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. An archery bow assembly, comprising:

a. an archery bow limb extending to a limb tip;

b. a rotatable element pivotally mounted to said limb tip on a pivot axis;

c. a cable arrangement including a yoke extending from a joint toward said rotatable element, wherein said yoke includes a first cable and a second cable diverging from said joint to opposing sides of said rotatable element;

d. at least one cable attachment fitting arranged on one side of said rotatable element, said fitting defining a guide surface spaced on an opposite side of said limb tip from said rotatable element and parallel to said rotatable element, wherein said guide surface defines a radial offset length from said pivot axis; and, e. wherein at least one of said first cable and said second cable is received on and carried by said guide surface to hold said cable away from and parallel to said rotatable element for the radial offset length of said attachment fitting.

2. The archery bow assembly of claim 1, wherein the one of the first cable and the second cable is connected to an anchor on said cable fitting.

3. The archery bow assembly of claim 2, wherein said anchor is coaxial with the pivot axis.

4. The archery bow assembly of claim 1, wherein said fitting includes a guide mounting engaging said one of said first and second cables to prevent the cable from falling off of the guide surface.

5. The archery bow assembly of claim 4, wherein said guide mounting is a passage defined by said fitting.

6. The archery bow assembly of claim 1, wherein said fitting defines a limb tip opening which straddles a portion of the limb tip.

7. The archery bow assembly of claim 6, wherein said limb tip opening comprises a fork arrangement including a pair of arms mounted to an axle of said rotatable element, and arranged on opposing sides of said limb.

8. The archery bow assembly of claim 7, wherein said fork arrangement comprises a support portion connecting said pair of arms at a point distal from said axle.

9. The archery bow assembly of claim 8, wherein said support portion is slanted at an angle approaching perpendicular to the cable portion diverging from the yoke as it approaches the fitting.

10. The archery bow assembly of claim 1, comprising a pair of cable attachment fittings arranged on opposing sides of said rotatable element, each fitting defining a guide surface parallel to said rotatable element and each guide surface defining a radial offset length from said pivot axis; wherein said first cable and said second cable are received on said respective guide surfaces and hold said first cable and said second cable away from and parallel to said rotatable element for said radial offset lengths.

11. The archery bow assembly of claim 1, wherein said archery bow assembly is a crossbow.

12. The archery bow assembly of claim 1, wherein said archery bow assembly is a vertical compound bow.

13. An archery bow assembly comprising:

a. a riser having opposing ends;

b. a pair of limbs extending from one end of said riser, each limb extending to a limb tip;

c. a rotatable element pivotally mounted between said limb tips on a pivot axis;

d. a cable arrangement extending to said rotatable element;

e. said cable arrangement including a yoke extending from a joint toward said rotatable element, wherein said yoke includes a first cable and a second cable diverging to opposing sides of said rotatable element;

f. a pair of cable attachment fittings arranged on opposing sides of said rotatable element, each attachment fitting defining a guide surface spaced on an opposite side of said limb from said rotatable element and parallel to said rotatable element, wherein each guide surface defines a radial offset length from said pivot axis;

g. each fitting defining a limb tip opening which straddles a limb tip; and, h. wherein said first cable and said second cable are received on and carried by a guide surface of a respective attachment fitting so that said cables are held away from and parallel to said rotatable element for the radial offset length of said attachment fittings.

14. The archery bow assembly of claim 13, wherein each fitting includes a guide mounting configured to prevent the cable from falling off of the guide surface.

15. The archery bow assembly of claim 14, wherein said guide mounting is a passage defined by said fitting.

16. The archery bow assembly of claim 13, wherein said limb tip openings are comprised of a fork arrangement including a support portion connecting a pair of arms at a point distal from said pivot axis.

17. The archery bow assembly of claim 16, wherein said support portion is slanted at an angle approaching perpendicular to the cable portion diverging from the yoke as it approaches the fitting.

18. An archery bow assembly comprising:

a. a riser having opposing ends;

b. at least one limb extending from an end of said riser to a limb tip;

c. a rotatable element pivotally mounted to said limb tip on an axle defining a pivot axis;

d. a cable arrangement extending to said rotatable element;

e. said cable arrangement including a yoke extending from a joint toward said rotatable element, wherein said yoke includes a first cable and a second cable diverging to opposing sides of said rotatable element;

f. first and second attachment fittings arranged on opposing sides of said rotatable element, each attachment fitting defining a radial offset length from the pivot axis; and, g. wherein the first cable and second cable extend to and contact said first and second attachment fittings at points spaced from the pivot axis by the radial offset length of each attachment fitting.

19. The archery bow assembly of claim 18, wherein axes defined by said first cable and said second cable meet at said joint, and wherein the axes of the first cable and second cable do not intersect the pivot axis of said axle within the length of said axle.

20. The archery bow assembly of claim 18, wherein axes defined by said first cable and said second cable meet at said joint and define a joint angle, wherein the joint angle is equal to or greater than 30 degrees.

* * * * *